US008672184B2

(12) United States Patent
Edwards

(10) Patent No.: US 8,672,184 B2
(45) Date of Patent: Mar. 18, 2014

(54) BAG IN BOX PACKAGING HAVING A LOCATING PANEL FOR A TAP

(75) Inventor: Simon P. Edwards, Irvine, CA (US)

(73) Assignee: Scholle Corporation, Irvine, CA (US)

( * ) Notice: Subject to any disclaimer, the term of this patent is extended or adjusted under 35 U.S.C. 154(b) by 9 days.

(21) Appl. No.: 13/338,504

(22) Filed: Dec. 28, 2011

(65) Prior Publication Data

US 2012/0217265 A1 Aug. 30, 2012

Related U.S. Application Data

(63) Continuation of application No. PCT/US2010/040658, filed on Jun. 30, 2010.

(60) Provisional application No. 61/269,893, filed on Jun. 30, 2009.

(51) Int. Cl.

| | |
|---|---|
| ***B65D 35/56*** | (2006.01) |
| ***B67D 7/06*** | (2010.01) |
| ***B65D 3/00*** | (2006.01) |
| ***B65D 5/56*** | (2006.01) |

(52) U.S. Cl.
USPC ..... 222/105; 222/185.1; 229/117.27; 229/117.3; 229/117.35

(58) Field of Classification Search
USPC ..... 222/105, 185.1, 527, 528, 529, 530, 222/531; 220/495.01, 495.05, 495.06; 229/100, 117.27, 117.29, 117.3
See application file for complete search history.

(56) References Cited

U.S. PATENT DOCUMENTS

| | | | | |
|---|---|---|---|---|
| 3,233,817 | A * | 2/1966 | Casady | 229/117.3 |
| 5,201,462 | A * | 4/1993 | Sada et al. | 229/125.15 |
| 5,731,021 | A * | 3/1998 | Spector | 426/111 |
| 5,829,637 | A * | 11/1998 | Takemura et al. | 222/81 |
| 6,105,821 | A * | 8/2000 | Christine et al. | 222/105 |
| 6,223,981 | B1 * | 5/2001 | Gunder | 229/242 |
| 6,637,623 | B2 * | 10/2003 | Muise et al. | 222/105 |
| 7,350,670 | B2 * | 4/2008 | Steeves et al. | 222/105 |
| 7,681,783 | B2 * | 3/2010 | Stephenson | 229/117.3 |
| 7,770,756 | B2 * | 8/2010 | Cook et al. | 222/105 |
| 8,162,180 | B2 * | 4/2012 | Lips | 222/105 |
| 8,261,964 | B2 * | 9/2012 | Raupach et al. | 229/117.3 |

* cited by examiner

*Primary Examiner* — Paul R Durand
*Assistant Examiner* — Vishal Pancholi
(74) *Attorney, Agent, or Firm* — The Watson I.P. Group, PLC; Jovan N. Jovanovic; Vladan M. Vasiljevic

(57) ABSTRACT

A bag in box packaging comprising an outer box, an inner bag and a locating panel. The outer box has a bottom wall and a dispensing wall with an opening. The inner bag includes a spout with a tap. The locating panel includes is coupled to the inner bag, the spout or the tap, with a dispensing opening of the tap on one side of the locating panel and the bag on the other side of The inner bag is placed within the box so that the central region is positioned at an angle relative to each of the bottom and dispensing walls. The front surface of the upper region overlies an inner surface of the dispensing wall. The front surface of the lower region overlies an inner surface of the bottom wall.

17 Claims, 4 Drawing Sheets

BAG IN BOX PACKAGING HAVING A LOCATING PANEL FOR A TAP

CROSS REFERENCE TO RELATED APPLICATION

This application is a continuation of PCT Int'l App. No. PCT/US2010/040658 filed Jun. 30, 2010, entitled "Bag In Box Packaging Having A Locating Panel For A Tap" which claims priority from U.S. Provisional Pat. App. No. 61/269,893 filed Jun. 30, 2009, entitled "Bag In Box Packaging Having A Locating Panel For A Tap", the entire specification of each of the applications is hereby incorporated by reference.

BACKGROUND OF THE DISCLOSURE

1. Field of the Disclosure

The disclosure relates in general to bag in box packaging, and more particularly, to a bag in box packaging that has a locating panel for a tap.

2. Background Art

The use of bag in box packaging is ubiquitous. In certain applications, a user can dispense flowable material through a tap directly from the bag in box packaging. One such application is wine dispensing, although, the invention is not limited to the same.

Conventionally, a bag having a fluid therewithin (such as, for example, wine) is provided. A tap is provided over a spout that is welded to the bag. The tap may comprise any number of different spouts that are conventionally used in such an application. The filled bag is dropped into an outer box. The outer box includes a removable portion which corresponds to the location of the tap within the outer box.

To access the tap, the user punctures the box proximate the removable portion and reaches into the box for the tap. The tap is then directed out of the box and one of the tap and the spout are coupled to the box. The tap can then be actuated to dispense product.

Problematically, for some users it is difficult to couple the tap to the outer box. Thus, the tap becomes difficult, if not impossible to use. In other instances, the tap may become dislodged from the outer box during use.

In addition, due to the manner in which the tap and bag are inserted into the outer box, there are many instances where the tap lies in an orientation which is difficult to reach. Furthermore, inasmuch as the opening in the box is typically used to secure the tap to the outer box, the opening is often too small to allow for a user to delve deeply into the outer box.

SUMMARY OF THE DISCLOSURE

The disclosure is directed to a bag in box packaging comprising an outer box, an inner bag and a locating panel. The outer box has a bottom wall and a dispensing wall with an opening toward the lower end thereof. The inner bag includes a spout with a tap. The locating panel has a front surface and a back surface. The locating panel includes a central region which is coupled to at least one of the inner bag, the spout and the tap, with a dispensing opening of the tap on one side of the locating panel and the bag on the other side of the locating panel. An upper region extends above the central region and a lower region extends below the central region. The inner bag is placed within the outer box so that the central region of the locating panel is positioned at an angle relative to each of the bottom wall and the dispensing wall. In turn, the front surface of the upper region overlies an inner surface of the dispensing wall. The front surface of the lower region overlies an inner surface of the bottom wall. The bottom wall, the dispensing wall and the locating panel define a tap region within the outer container within which the tap is positioned when in a stowed configuration. The tap is accessible through the opening in the dispensing wall.

In a preferred embodiment, the outer box is substantially cuboid configuration with dispensing wall and the bottom wall being substantially perpendicular to each other.

In another preferred embodiment, the dispensing wall includes a width and the width of the locating panel has a width which substantially matches the width of the locating panel.

In another preferred embodiment, the central region includes an opening through which the tap is extended. Additionally, the upper region is separated from the central region by one of a fold line and a score line. Finally, the lower region is separated from the central region by one of a fold line and a score line.

Preferably, the central region comprises a substantially rectangular configuration. Each of the upper region and the lower region comprise substantially rectangular configurations.

In another preferred embodiment, the dispensing wall includes a frangible cover over the opening therethrough.

In another preferred embodiment, the locating panel is retained in the desired oblique position without the use of an adhesive on the upper region and the lower region of the locating panel.

In another preferred embodiment, the locating panel defines an included angle between the front surface of the locating panel and the bottom wall, with the included angle being between approximately 40° and 70°.

In another aspect of the disclosure, the disclosure comprises a method of assembling a bag in box package. The method includes the steps of providing an outer box having a plurality of walls defining an enclosure, and also including a bottom wall and a dispensing wall with an opening toward its lower end; providing an inner bag having a spout with a tap, the inner bag positioned within the outer box; providing a locating panel having a front surface and a back surface, and also including a central region an upper region extending above the central region and a lower region extending below the central region; coupling a portion of at least one of the inner bag, the spout and the tap to the central region so that the tap extends beyond the front surface, and the bag extends beyond the back surface; filling the inner bag with a flowable material; dropping the inner bag into the outer box so that the lower region abuts the bottom wall and so that the upper region abuts the top wall with the central region being oblique to both, and so that the tap is positioned in a tap region defined by the dispensing wall, the bottom wall and the locating panel, with a user having access to the tap through the opening; and sealing the outer box to retain the inner bag inside the outer box.

In a preferred embodiment, the method further comprises the step of installing a frangible cover over the opening in the dispensing wall to preclude inadvertent extension of the tap therethrough.

In another preferred embodiment, the method further comprises the steps of providing an opening through the central region of the locating panel; and extending the tap through the locating panel, prior to the step of coupling the locating panel.

The disclosure is likewise directed to a method of preparing a bag in box package of the type shown herein for dispensing comprising the steps of: at least one of rotating and translating the locating panel relative to the dispensing wall, to place the central region of the locating panel toward abutment with the dispensing wall, and, to, in turn, extend the tap through the opening in the dispensing wall.

Preferably, the method further comprises the steps of sliding the lower region of the locating panel along the bottom wall toward the dispensing wall; sliding the upper region of the locating panel along the dispensing wall away from the bottom wall, to, in turn, direct the tap toward the opening in the dispensing wall.

In another preferred embodiment, the method further includes the step of placing the front surface of the locating panel in substantial abutment with the dispensing wall.

Preferably, the opening of the dispensing wall further includes a frangible cover, the method further including the step of removing the frangible cover from the opening in the dispensing wall.

BRIEF DESCRIPTION OF THE DRAWINGS

The disclosure will now be described with reference to the drawings wherein.

DETAILED DESCRIPTION OF THE DISCLOSURE

Figure 1A:
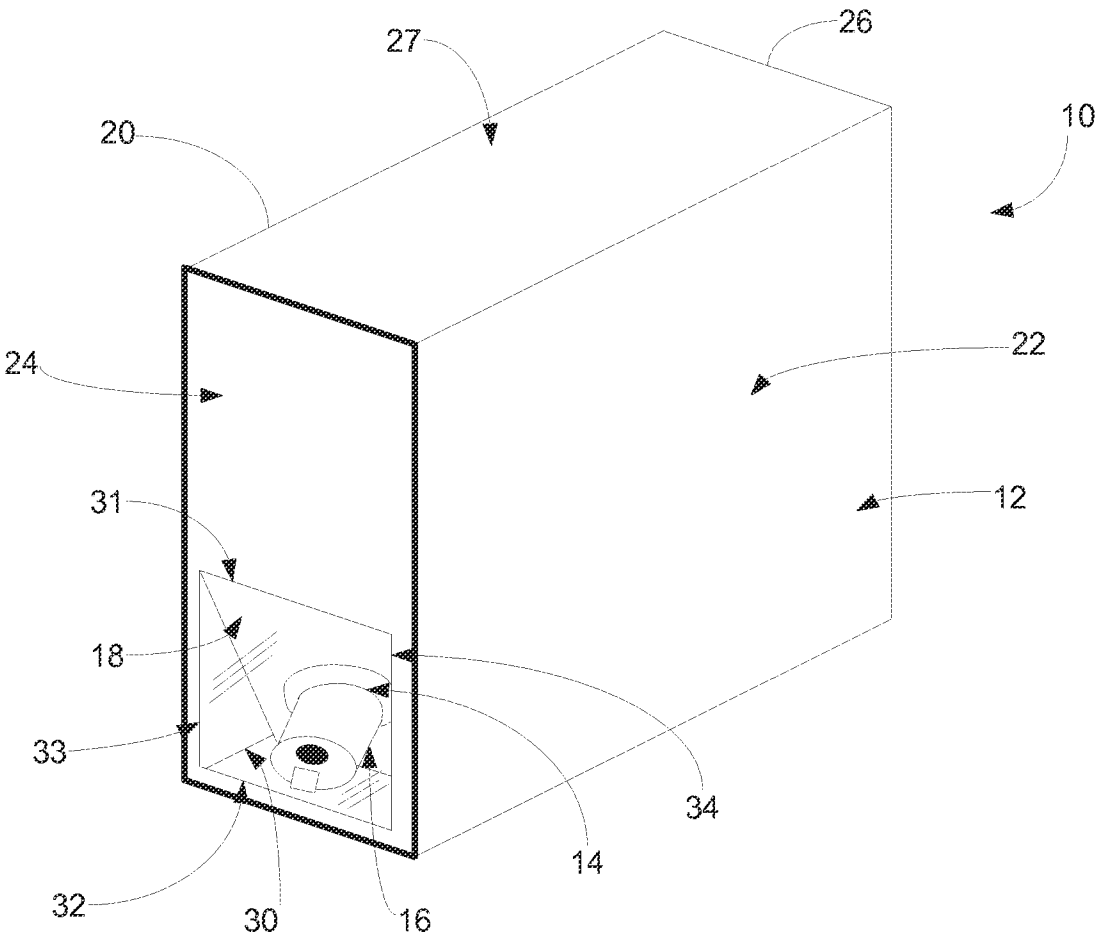
FIG. 1*a* of the drawings is a perspective view of a bag in box package made in accordance with the teachings of the present invention, showing in particular, the tap in a storage and shipping position.

While this invention is susceptible of embodiment in many different forms, there is shown in the drawings and described herein in detail a specific embodiment with the understanding that the present disclosure is to be considered as an exemplification and is not intended to be limited to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, bag in box packaging is shown generally at 10. The bag in box packaging can be utilized in association with any number of different flowable materials. Inasmuch as one feature of the invention is the location of a tap, one use of the bag in box packaging is its use in association with wine products and the like. It will be understood that the invention is not limited to its use in association with wine products, and such use is described only for purposes of being exemplary. In other embodiments, other fluids can be utilized in its stead.

Figure 1B:
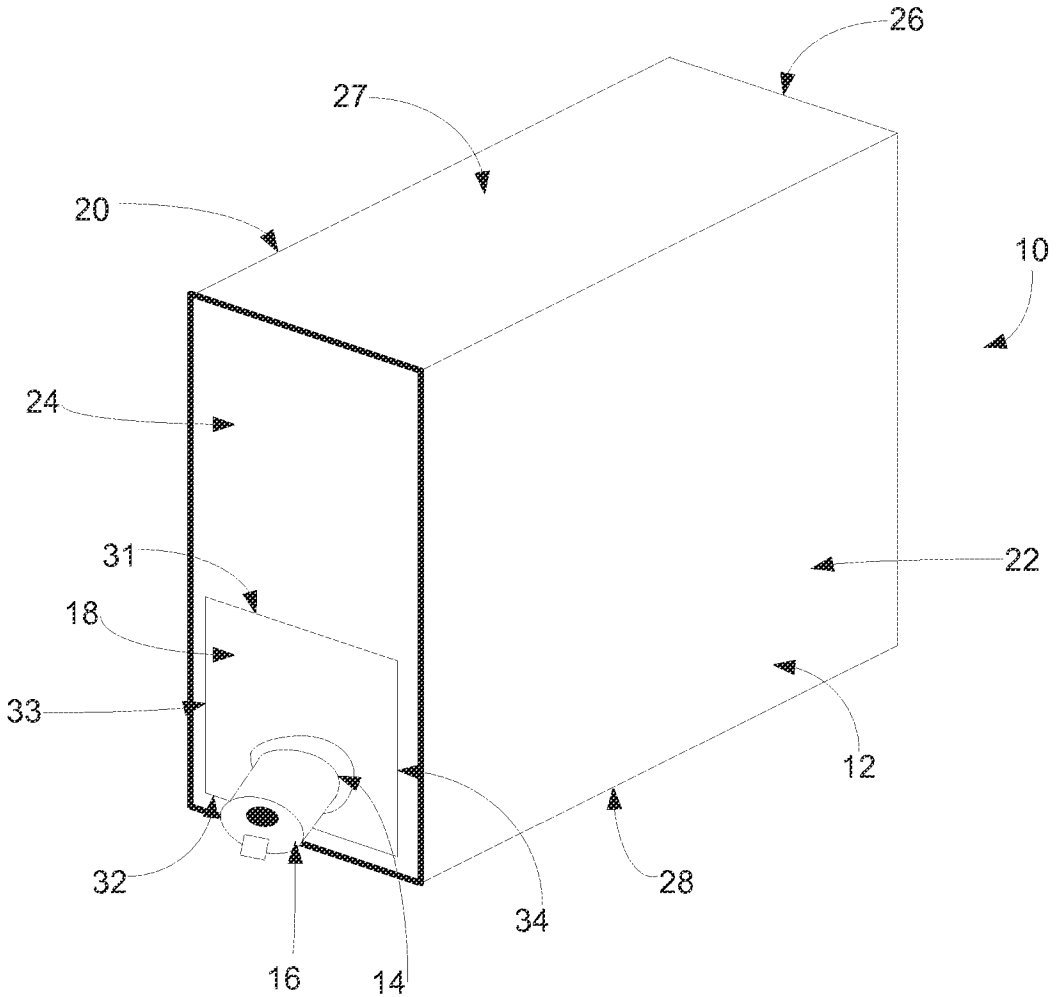
FIG. 1*b* of the drawings is a perspective view of a bag in box package made in accordance with the teaching of the present invention, showing in particular, the tap in a deployed tap dispensing position.

The bag in box packaging is shown in FIGS. 1*a* and 1*b* as comprising outer box 12, inner bag 14, tap 16 and locating panel 18. The outer box 12 comprises a generally cuboid container (although variously shaped containers are contemplated for use). The outer box 12 includes first sidewall 20, second sidewall 22, front wall 24 (also referred to as the dispensing wall), back wall 26, top wall 27 and bottom wall 28. In the configurations shown, the first and second sidewalls have a larger surface area than the remaining walls. The front wall and the back wall comprise narrow, elongated wall structures. Again, a number of different shapes are contemplated, as long as they include a bottom wall and a dispensing wall and the foregoing comprises a description of a preferred embodiment.

In the embodiment shown, the outer box 12 may comprise a corrugated paperboard material. In other embodiments, the outer box may comprise a single or multiply paperboard material. In still other embodiments, corrugated polymer board, or polymer board may be utilized. Indeed, the invention is not limited to any particular material from which the outer box 12 is formed.

The dispensing wall 24 includes opening 30 at the lower end thereof The opening is defined by first side edge 33, second side edge 34, top edge 31 and bottom edge 32. The opening is sized so as to permit a user to stick his or her hand through the opening and to retrieve the tap positioned therein. In certain embodiments, the opening 30 may be covered with a paperboard material. For example, the dispensing wall may include perforations which define the opening (i.e., a frangible cover of the wall), and the user can remove a portion of the dispensing wall to create the opening. In other embodiments, a separate frangible cover may be utilized, such as a cover made from a clear polymer film, a paperboard substrate, a metal foil member, or another covering material.

Figure 2:
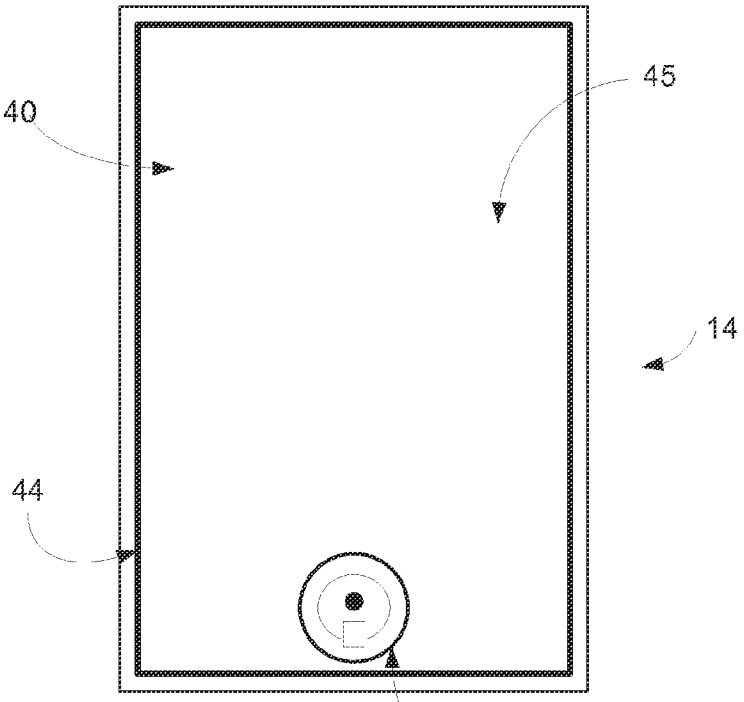
FIG. 2 of the drawings is a front elevational view of the inner bag which is inserted into the outer box of the present invention.

The inner bag 14 is shown in FIG. 2 as comprising front panel 40, back panel 42 (FIG. 5), seals 44 and spout 46. The inner bag 14 is shown as comprising a conventional pillow-type container. In other embodiments, gusseted containers are likewise contemplated for use. The front panel 40 and the back panel 42 (FIG. 5) are generally coextensive and positioned in an overlying configuration. The two panels are joined together with seals, such as seals 44 which generally extend about the periphery of the two panels. The seals and the front and back panel cooperate to define cavity 45 which is substantially a fluid-tight cavity. Spout 46 provides ingress and egress of fluid into and from within the cavity 45. The spout typically includes a flange that is welded to the inside or the outside of the front panel, and includes a plurality of flanges disposed along the length thereof The inner bag is sized so as to fit within the outer box.

Tap 16 is coupled to the spout 46. The tap 16 may comprise any number of different types and styles of taps. For example, one such tap comprises the tap shown in any one of the following patents, namely, U.S. Pat. Nos. 4,619,377 and 6,978,981 both of which are issued to Roos as well as U.S. Pat. Nos. 6,045,119; 6,296,157 and 6,360,925 issued to Erb. Of course, other taps are likewise contemplated. Each of the foregoing patents are incorporated herein by reference in their entirety.

Figure 3:
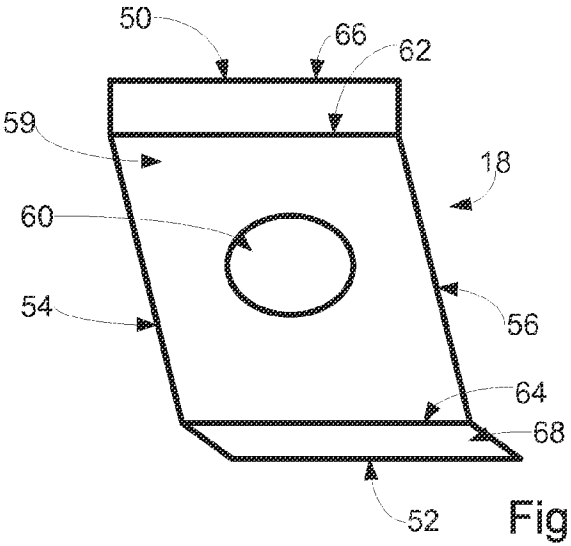
FIG. 3 of the drawings is a perspective view of the locating panel used in association with the outer box of the present invention.
Figure 4:
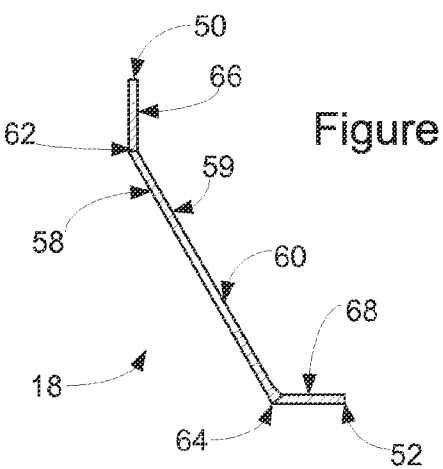
FIG. 4 of the drawings is a side elevational view of the locating panel used in association with the outer box of the present invention.
Figure 5:
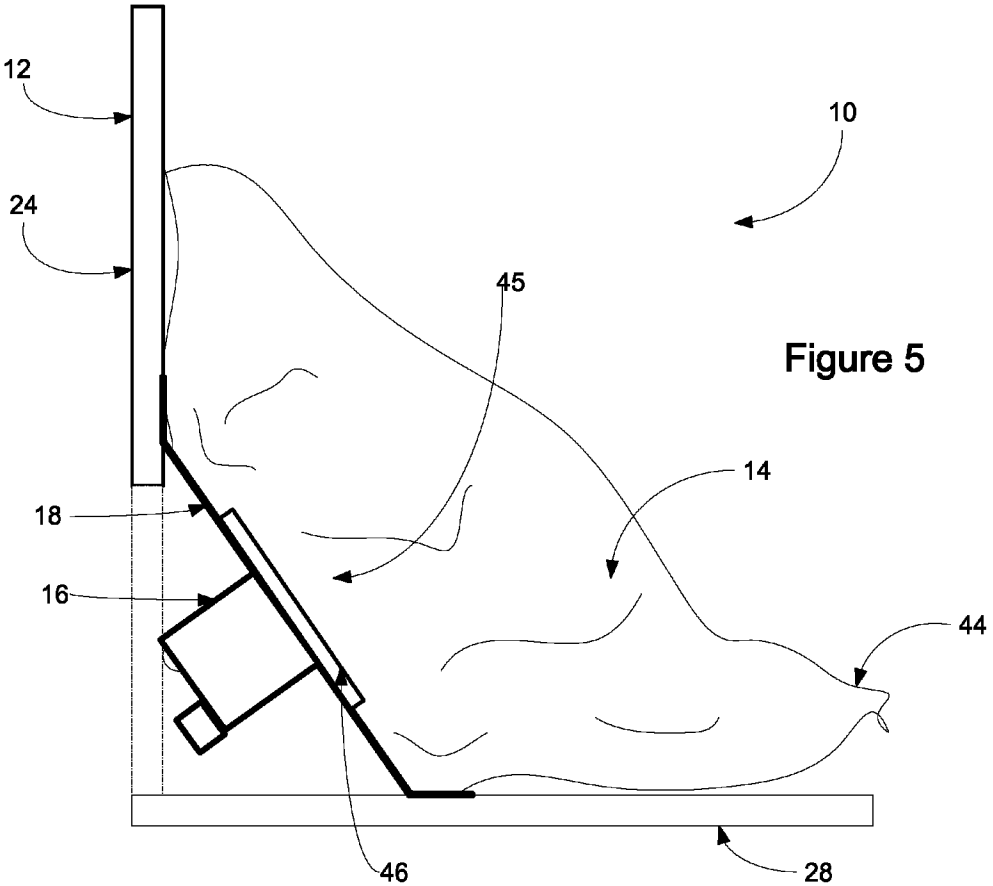
FIG. 5 of the drawings is a partial side elevational view of the assembled outer box, inner bag and locating panel of a bag in box package of the present invention.

The locating panel 18 is shown in FIGS. 3-5 as comprising a planar member, made from, for example, a paperboard material (of course a polymer member is likewise contemplated for use). The locating panel includes front surface 58 and back surface 59 which are substantially uniform, as the panel comprises a member of a substantially uniform thickness. The panel includes upper edge 50, lower edge 52, first side edge 54, second side edge 56. An opening is positioned within the confines of the edges to allow for the spout or tap or both to extend therethrough. The back surface 59 is coupled to one or both of the spout and the bag through adhesive or mechanical means. In certain embodiments, the panel may be formed together with the spout, or may be welded to the spout or the bag.

In another embodiment, a slot may be provided, or multiple panels can be used to from the locating panel wherein the tap extends on one side (i.e., extending from and beyond the front surface) while the bag extends on the other side (i.e., extending from and beyond the back surface)

The locating panel includes top fold score 62 and bottom fold score 64 which extend substantially from first side edge 54 to second side edge 56. The fold scores 62, 64 are positioned on opposing sides of the opening. As will be explained, the scores serve to define the angle at which the locating panel rests relative to the dispensing wall 24 and the bottom wall 28. Additionally, depending on the location of the top and bottom fold scores 62, 64, the position of the tap 16 will likewise be affected. By varying the positioning of the scores, and the relative distance between the scores, the positioning of the locating panel 18 can be varied to accommodate a number of different taps. For example, a longer tap may require that the locating panel 18 be positioned at an angle relative to the dispensing wall 24 and bottom wall 28 that is different than a shorter tap. It is contemplated that the included angle defined by the front surface of the locating panel and the bottom wall is between 40° and 70°, most preferably, while other angles are likewise contemplated.

In operation, the user first provides an outer box 12 for the bag in box packaging 10. Additionally, an inner bag 14 is provided along with a tap 16. The inner bag 14 is filled with a flowable material. Typically, when such inner bags are filled, the spout is retained during filling. Once filled, the spout is typically sealed with a cap, or in his instance, a tap.

After filling, and while the spout is retained, the locating panel is coupled to one or both of the spout and the bag. For example, the locating panel can be glued to the spout and/or bag. In another example, the locating panel can be manually coupled to the spout and/or bag. The orientation of the locating panel relative to the spout and bag is done with the final position of the bag within the outer box in mind.

Once the locating panel is positioned, the inner bag is controlled with respect to the relative position of the locating panel. For example, the inner bag with locating panel can be positioned into a funnel assembly (not shown) which prepares the bag for dropping into an outer box. A structure may be present on the funnel assembly to specifically capture and maintain the locating panel or the spout in a desired orientation within the funnel With such a configuration, as the inner bag progresses through the funnel assembly, the locating panel position is controlled so that the bag drops into the outer box so that the locating panel spans between the dispensing wall and the bottom wall, interfacing with the dispensing wall with the top fold score 62 and with top flap 66 extending along the dispensing wall above opening 30. Similarly, the bottom fold score 64 interfaces with the bottom wall 28 with bottom flap 68 extending along the bottom wall. The locating panel 18 overlies opening 30 and is angularly disposed thereto. In turn, the tap falls into the tap region created by the locating panel, the dispensing wall and the bottom wall.

It is contemplated that the locating panel is configured dimensionally so that the locating panel is maintained in the desired orientation (or within a close enough configuration to the locating panel) by the fluid pressure from the flowable material positioned within the inner bag coupled with the natural friction between the locating panel portions that are abutting the dispensing wall and the bottom wall. In some embodiments, it may be necessary to treat the surfaces of either the walls or the locating panel to increase the friction between the components. In other embodiment, it may be necessary to use an adhesive (which can be easily overcome by the force of the user) to maintain the desired configuration of the locating panel during shipment (i.e., the configuration wherein the tap is stowed).

Once positioned, the outer box can be sealed. Typically, the inner bag 14 is inserted into the outer box through what would be the top wall 27. After insertion of the inner bag 14 into the outer box, the top wall 27 is sealed. Typically, a number of panels cooperate to form the top wall. Once sealed, the bag in box container is ready for shipment, display and dispensing. Such a configuration is shown in FIG. 1*a*.

To dispense product from within the bag in box packaging 10, the user first gains access to tap 16. To gain access to the tap, the user removes that which is covering opening 30 on dispensing wall 24. In certain embodiments, this may be a frangible portion of the dispensing wall 24. In other embodiments, this may be a different type of frangible cover, such as a clear polymer film. Still other examples are disclosed above, and are not deemed to be limiting or exhaustive. In other embodiments, the opening may be present without any such covering thereover.

Once the tap 16 has been exposed, the user reaches into the outer box 12 and grasps the tap 16. Upon pulling of the tap, the locating panel 18 rotates and translates so that it eventually covers opening 30 in an abutting fashion. In situations where the flowable material is pressing against the locating panel, as the user pulls on the tap, the upper region slides along the dispensing wall away from the opening, and the lower region slides along the bottom wall toward the opening until the central region of the locating panel substantially abuts the dispensing wall. In the embodiment shown, the dispensing wall and the central region of the locating panel are substantially planar, with the locating panel covering substantially the entirety of the opening in the dispensing wall.

Thus, the tap 16 extends through the opening 30 and is ready for use. Upon positioning of the locating panel 18 in the dispensing position, the configuration of the locating panel along with the pressure exerted upon the locating panel from behind by the flowable material, maintain the tap in the desired position substantially external of the outer container. The tap can then be used to empty the contents of the bag. Such a ready to dispense configuration is shown in FIG. 1*b*.

It is contemplated that for retransport or restorage, the tap can be pushed inwardly to again reform the tap region and to stow the tap. In other embodiments, an adhesive may be present on the central region and/or on the dispensing wall surrounding the opening so that when the central region and the dispensing wall are in abutment, the adhesive maintains the abutment, and in turn, the deployed orientation.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A bag in box packaging comprising:

an outer box having a plurality of walls defining an enclosure, and including a bottom wall and a dispensing wall with the bottom wall and the dispensing wall meeting at an edge, the dispensing wall having an opening toward the lower end thereof;

an inner bag having a spout with a tap, the inner bag positioned within the outer box;

a locating panel separate from and disconnected from the outer box, the locating panel having a front surface and a back surface, the locating panel including a central region having an upper edge and a lower edge opposite the upper edge, the central region being coupled to at least one of the inner bag, the spout and the tap, with a dispensing opening of the tap on the front surface of the locating panel and the bag on the back surface of the locating panel, an upper region extending above the central region from the upper edge with the front surface thereof slidably positionable along the dispensing wall and a lower region extending below the central region from the lower edge with the front surface thereof slidably positionable along on the dispensing wall, wherein the inner bag is placed within the outer box and with the locating panel slidably and rotatably orientatable from a stowed configuration to a dispensing configuration, in the stowed orientation, the central region of the locating panel is positioned at an oblique angle relative to each of the bottom wall and the dispensing wall, with the front surface of the upper region overlying an inner surface of the dispensing wall, and the front surface of the lower region overlying an inner surface of the bottom wall, such that the central region is oblique to both the upper region and the lower region, wherein the bottom wall, the dispensing wall and the locating panel define a tap region within the outer container within which the tap is positioned when in the stowed configuration, wherein the tap is accessible through the opening in the dispensing wall, and wherein directing of the locating panel from the stowed configuration to the dispensing configuration, the central region is rotated and translated relative to the dispensing wall while the front surface of the lower region of the locating panel slidably translates along the bottom wall toward the dispensing wall and while the front surface of the upper region of the locating panel simultaneously slidably translates along the dispensing wall away from the bottom wall until the central region of the locating panel substantially abuts the inner surface of the dispensing wall and the tap extends through the opening in the dispensing wall.

2. The bag in box packaging of claim 1 wherein the outer box is substantially cuboid configuration with dispensing wall and the bottom wall being substantially perpendicular to each other.

3. The bag in box packaging of claim 2 wherein the dispensing wall includes a width and the width of the locating panel having a width which substantially matches the width of the locating panel.

4. The bag in box packaging of claim 1 wherein the central region includes an opening through which the tap is extended, and the upper edge is one of a fold line and a score line, and the lower edge is one of a fold line and a score line.

5. The bag in box packaging of claim 1 wherein the central region comprises a substantially rectangular configuration, with each of the upper region and the lower region comprising substantially rectangular configurations.

6. The bag in box packaging of claim 1 wherein the dispensing wall includes a frangible cover over the opening therethrough.

7. The bag in box packaging of claim 1 wherein the locating panel is rotatably and slidably movable relative to the outer box and retained in the desired oblique position without the use of an adhesive on the upper region and the lower region of the locating panel.

8. The bag in box packaging of claim 1 wherein in the stowed orientation, the locating panel defines an included angle between the front surface of the locating panel and the bottom wall, with the included angle being between approximately 40° and 70°.

9. A method of assembling a bag in box package:

providing an outer box having a plurality of walls defining an enclosure, and including a bottom wall and a dispensing wall with an opening toward the lower end thereof;

providing an inner bag having a spout with a tap, the inner bag positioned within the outer box;

providing a locating panel having a front surface and a back surface, the locating panel including a central region having an upper edge and a lower edge, an upper region extending above the central region from the upper edge and a lower region extending below the central region from the lower edge, the locating panel being a separate component from the outer box, coupling a portion of at least one of the inner bag, the spout and the tap to the central region of the locating panel so that the tap extends beyond the front surface, and the bag extends beyond the back surface;

filling the inner bag with a flowable material;

dropping the inner bag into the outer box after the step of coupling of the locating panel so that the lower region slidably abuts the bottom wall and so that the upper region slidably abuts the dispensing wall with the central region being oblique to both, and so that the tap is positioned in a tap region defined by the dispensing wall, the bottom wall and the locating panel, with a user having access to the tap through the opening, wherein the front surface of the lower region is slidably movable along the bottom wall, and the front surface of the upper region is slidably movable along the dispensing wall, and wherein the central region is slidably and rotatably movable relative to each of the dispensing wall and the bottom wall through the simultaneous slidable movement of the upper region along the dispensing wall and the lower region along the bottom wall;

sealing the outer box to retain the inner bag therewithin.

10. The method of assembling the bag in box package of claim 9 further comprising the step of installing a frangible cover over the opening in the dispensing wall to preclude inadvertent extension of the tap therethrough.

11. The method of assembling the bag in box package of claim 9 further comprising the steps of:

providing an opening through the central region of the locating panel; and extending the tap through the locating panel, prior to the step of coupling the locating panel.

12. A method of preparing the bag in box package of claim 1 for dispensing comprising the steps of:

at least one of rotating and translating the locating panel relative to the dispensing wall, to place the central region of the locating panel toward abutment with the dispensing wall, and, to, in turn, extend the tap through the opening in the dispensing wall.

13. The method of claim 12 further comprising the steps of:

sliding the lower region of the locating panel along the bottom wall toward the dispensing wall;

sliding the upper region of the locating panel along the dispensing wall away from the bottom wall, to, in turn, direct the tap toward the opening in the dispensing wall.

14. The method of claim 12 comprising the step of placing the front surface of the locating panel in substantial abutment with the dispensing wall.

15. The method of claim 12 wherein the opening of the dispensing wall further includes a frangible cover, the method further including the step of:

removing the frangible cover from the opening in the dispensing wall.

16. The bag in box packaging of claim 1 wherein directing of the locating panel from the stowed configuration to the dispensing configuration, as the central region is rotated relative to the dispensing wall, the upper region of the locating panel slidably translates along the dispensing wall away from the bottom wall until the central region and the dispensing wall are substantially coplanar.

17. The bag in box packaging of claim 1 wherein , the bottom wall and the dispensing wall are substantially fixed relative to each other upon full assembly of the outer box, with the bottom wall and the dispensing wall being adjacent walls of the outer box, thereby meeting at an edge.

* * * * *